United States Patent [19]

Satoh et al.

[11] Patent Number: 4,565,164

[45] Date of Patent: Jan. 21, 1986

[54] INTERNAL COMBUSTION ENGINE CYLINDER-HEAD COVER

[75] Inventors: Masayuki Satoh, Toyota; Yoshisada Wada, Okazaki, both of Japan

[73] Assignee: Toyota Jidosha Kabushiki Kaisha, Japan

[21] Appl. No.: 690,180

[22] Filed: Jan. 10, 1985

[30] Foreign Application Priority Data

Jan. 30, 1984 [JP] Japan ..... 59-14735

[51] Int. Cl.[4] ..... F01M 13/04

[52] U.S. Cl. ..... 123/41.86; 123/572

[58] Field of Search ..... 123/41.86, 572, 573

[56] References Cited

U.S. PATENT DOCUMENTS

| | | | |
|---|---|---|---|
| 2,796,853 | 6/1957 | Van Ranst | 123/41.86 |
| 2,974,652 | 3/1961 | Benzinger | 123/41.86 |
| 4,156,406 | 5/1979 | Brandau et al. | 123/41.86 |
| 4,175,937 | 11/1979 | Brandau et al. | 123/41.86 |

FOREIGN PATENT DOCUMENTS 30-152313 4/1954 Japan .

31-149013 4/1955 Japan .

*Primary Examiner*—William A. Cuchlinski, Jr.

*Attorney, Agent, or Firm*—Parkhurst & Oliff

[57] ABSTRACT

A cylinder-head cover for use in an internal combustion engine, which effectively separates oil and contaminants from blowby gas-oil mixture prior to the time when the blowby gas-oil mixture is suctioned into an intake passage. The cylinder-head cover has extension portions which extend in its lateral direction, and is attached by a curved plate onto its back side, thereby forming a space between the cylinder-head cover and the curved plate. The curved plate has grooves which extends in zigzags relative to its longitudinal direction. The blowby gas-oil mixture passes through the space defined between the cylinder-head cover and the curved plate. As the volume of the space is repeatedly large and small, the flow speed of the blowby gas-oil mixture reduces at the place where the space is large. Hence, the oil or contaminants drop by its weight. Thus, the oil and contaminants, which are contained in the blowby gas, are separated.

4 Claims, 11 Drawing Figures

INTERNAL COMBUSTION ENGINE CYLINDER-HEAD COVER

BACKGROUND OF THE INVENTION

The present invention relates to an apparatus for separating oil and contaminants from gas-oil mixtures, and more particularly to a combustion gas-oil contaminant separator for use in internal combustion engines. During operation of an internal combustion engine, combustion gases pass through the small clearance defined between the piston rings and the inner wall of the pistons and enter the crank case. Also engine oil is mixed with the combustion gases by the reciprocation and rotation of the engine components must be separated in order to reduce the comsumption of the engine oil.

Heretofore, there has been proposed a gas-oil separator 8 which is provided in a cylinder-head cover, as shown in FIG. 10. The gas-oil separator 8 has a curved plate 21 which is fixed onto an inner wall 9 of a cylinder-head cover 2. As shown in FIG. 9, the cylinder-head cover 2 has a first extension portion 12 which extends in its longitudinal direction (the direction indicated by the reference Q) and a second extension portion 13 which extends in its lateral direction (the direction indicated by the reference P). The back side portions of the first and second extension portions 12 and 13 are concave, thereby forming a space between the curved plate 21 and the cylinder-head cover 2. This space forms a passage 11 through which blowby gas flows, as shown in FIG. 11. The first extension 12 of the cylinder-head cover 2 forms a part of the passage 11, in which the blowby gas flows in the longitudinal direction of the cylinder-head cover 2 (the direction indicated by the reference Q—Q in FIG. 11). Further, the second extension 13 of the cylinder-head cover 2 forms a part of the passage 11, in which the blowby gas flows in the lateral direction of the cylinder-head cover 2 (the direction indicated by the reference P—P in FIG. 11). The blowby gas enters the passage 11 from an inlet port 15 and exhausts from an outlet port 16. According to the prior cylinder-head cover 2 as shown in FIG. 9, the rigidity of the cylinder-head cover 2 is lowered, particularly in the lateral direction of the cylinder-head cover 2. This is based upon the reason why the first extension portions 12 are provided at both lateral sides of the cylinder-head cover 2. Further, according to the prior cylinder-head cover, the separation between gas and oil is not satisfactory.

SUMMARY OF THE INVENTION

The present invention was made in view of the foregoing background and to overcome the foregoing drawbacks. It is accordingly an object of this invention to provide an internal combustion engine cylinder-head cover which can effectively separate oil and contaminants from the blowby gas-oil mixture.

To attain the above objects, an internal combustion engine cylinder-head cover according to the present invention has a housing secured to a cylinder head, and a plate which is provided within the housing. The housing has a plurality of extension portions which extend in lateral direction thereof, an inlet opening for introducing the blowby gas-oil mixture into the housing, and an outlet opening for returning the blowby gas into the intake passage. The plate forms a passage between its outer surface and an inner surface of the housing, in which the blowby gas-oil mixture passes. Further, the plate has its outer surface on which a groove is formed such a way as the square of the cross-section of the passage is repeatedly large and small. When a blowby gas-oil mixture passes through a cylinder-head cover, the oil and contaminants contained in the blowby gas-oil mixture drops on the outer surface of the plate at the place where the square of the cross-section of the passage is large, and thereby the oil and contaminants are separated from the blowby gas-oil mixture.

BRIEF DESCRIPTION OF THE DRAWINGS

The above objects, features and advantages of the present invention will become more apparent from the following description of the preferred embodiments taken in conjunction with the accompanying drawings, wherein.

DETAILED DESCRIPTION OF THE PREFERRED EMBODIMENTS

The present invention is described in detail with reference to the accompanying drawings which illustrate different embodiments of the present invention.

Figure 1:
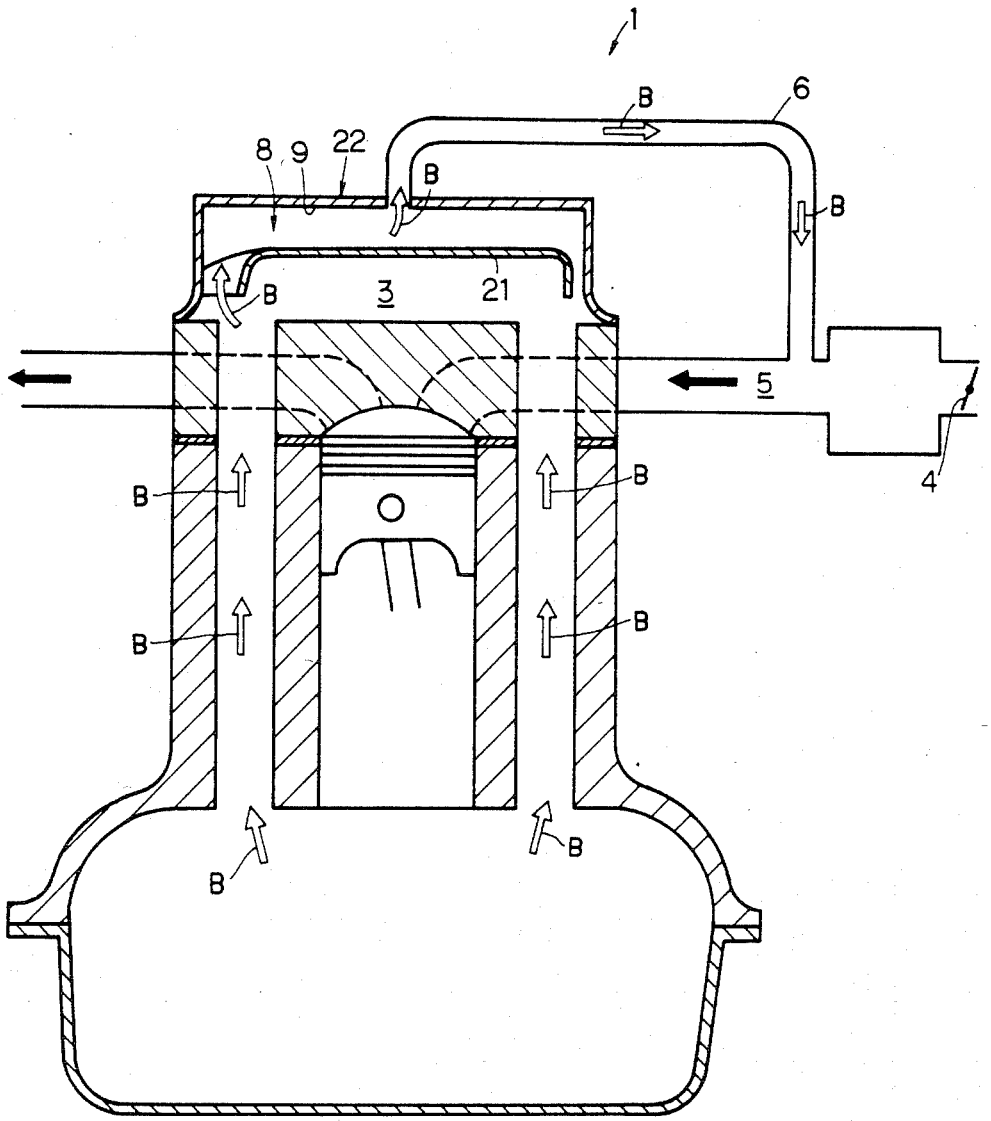
FIG. 1 is a cross-sectional view of an internal combustion engine equipped with a blowby gas ventilation apparatus.

FIG. 1 shows a cross-sectional view of an internal combustion engine equipped with a blowby gas ventilation apparatus 1. The blowby gas ventilation apparatus 1 has a passage 6 which communicates a chamber 3 within the cylinder-head cover 2 with an intake passage 5 which is the downstream part of a throttle valve 4. The blowby gas, which passes through the small clearance between the piston rings and the inner wall of the pistons and enters the crank case, is suctioned into the intake passage 5 by the negative pressure generated in the intake passage 5. The blowby gas is suctioned through the passage 6 into the intake passage 5. The suctioned blowby gas is returned into the engine, and burns in the combustion chamber.

During the operation of the engine, an engine oil circulates within the engine in order to lubricate the parts. Hence, the blowby gas includes an amount of oil mist therein. If the blowby gas containing the amount of oil mist is supplied into the intake passage 5, the consumption of the engine oil increases. Due to this, a gas-oil separator 8 is provided.

Figure 2:
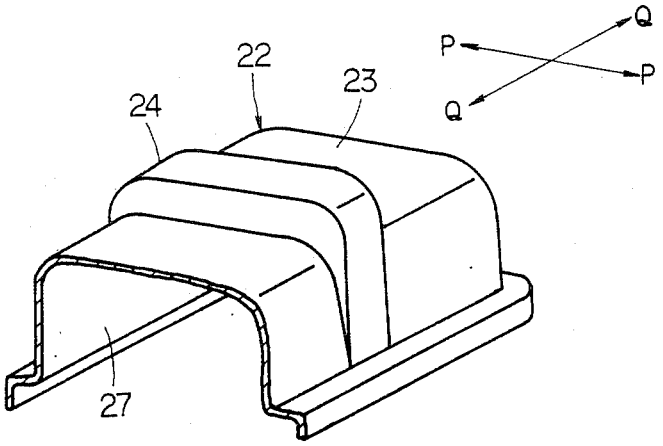
FIG. 2 is a partial perspective view of a cylinder-head cover which is employed in an embodiment of the present invention.

FIG. 2 shows a partial perspective view of a cylinder-head cover 22 which is employed in an embodiment of the present invention. The cylinder-head cover 22 comprises a housing 23. The housing 23 has a plurality of extension portions 24 which are provided at a distance in its longitudinal direction (the direction indicated by the reference Q—Q in FIG. 2) and which extends in its lateral direction (the direction indicated by the reference P—P in FIG. 2). The back side of the extension portions 24 of the cylinder-head cover 22 forms an inner wall 27 which is concave.

Figure 3:
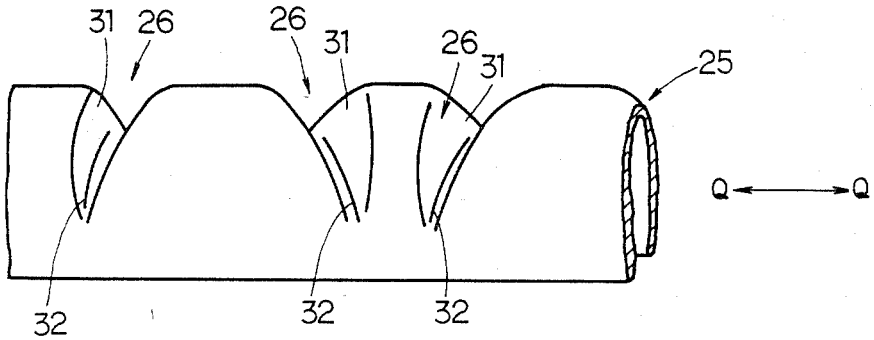
FIG. 3 is a partial perspective view of a curved plate which is employed in the embodiment of the present invention.
Figure 4:
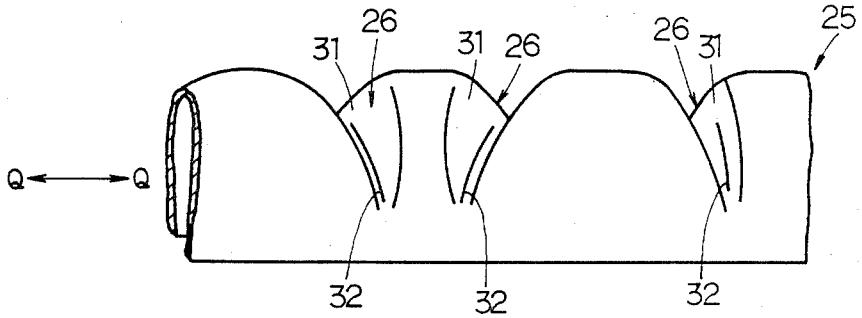
FIG. 4 is a partial perspective view of a curved plate which is viewed from the opposite direction to that in FIG. 3.

FIGS. 3 and 4 are partial perspective views of the curved plate 25 which is attached into the inner wall 27 of the cylinder-head cover 22. The curved plate 25 in FIG. 4 is a view which is seen from the opposite direction to that in FIG. 3. As shown in FIGS. 3 and 4, there are provided a plurality of grooves 26 on the curved plate 25, which obliquely extend relative to the longitudinal direction thereof (the direction indicated by the reference Q—Q in FIGS. 3 and 4). The depth of the grooves 26 is adapted to be large at its central portion 31 and to be small at its lateral both ends 32. Further, the groove 26 extends on the curved plate 25 in zigzags in its longitudinal direction (the direction indicated by the reference Q—Q).

Figure 5:
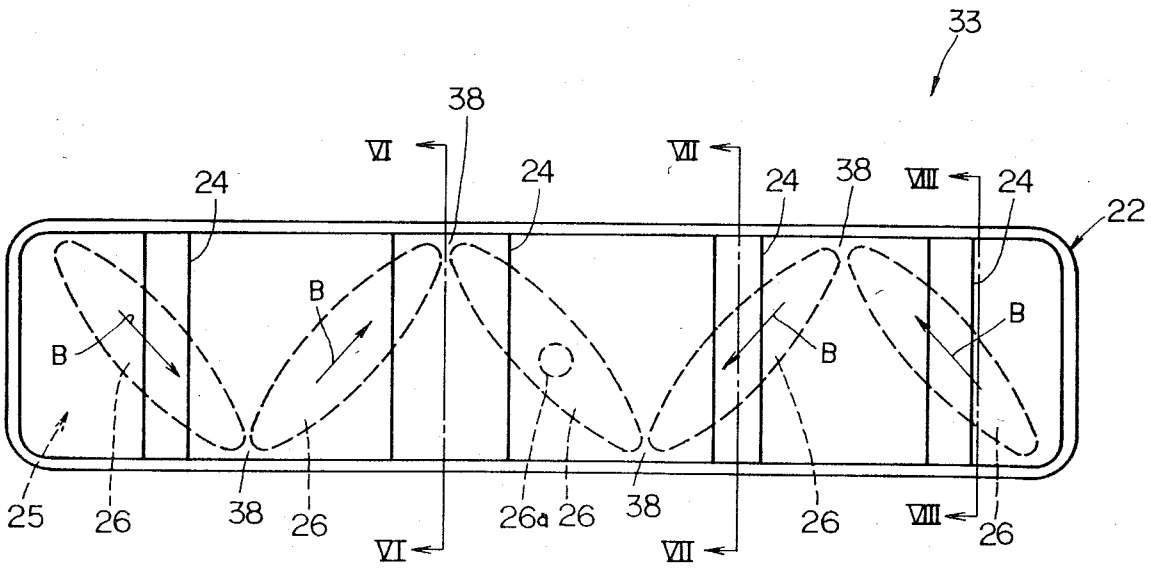
FIG. 5 is a top view of a cylinder-head cover according to an embodiment of the present invention.

FIG. 5 shows a top view of the cylinder-head cover according to an embodiment of the present invention. The curved plate 25 is attached onto the inner wall 27 of the cylinder-head cover 22. In FIG. 5, the extension portions 24 of the cylinder-head cover 22 vertically extends in such a direction as the extension portions 24 become more distant away from the curved plate 25. Further, the back side of the extension portion 24 is concave in such a way as the back side of the extension portion 24 becomes more distant from the curved plate 25. Further, the grooves 26 of the curved plate 25 are formed to be concave in such a direction as the groove 26 becomes distant away from the cylinder-head cover 22.

Figure 6:
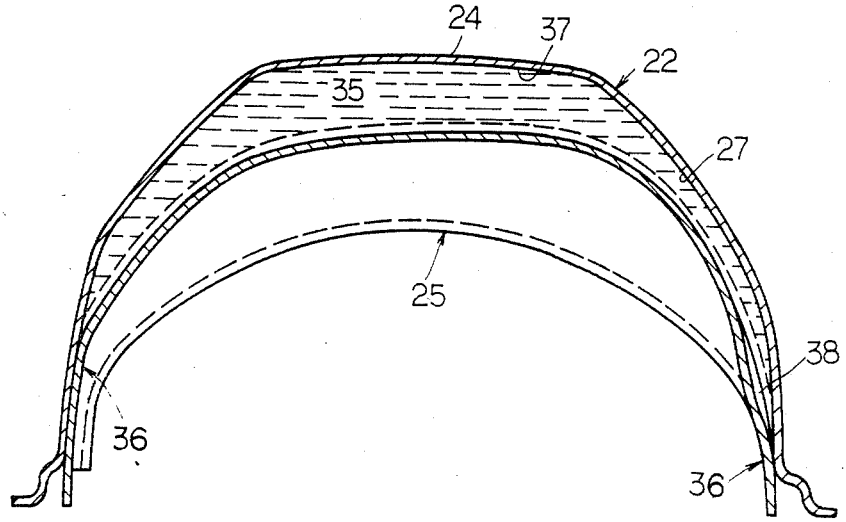
FIG. 6 is an enlarged corss-sectional view taken along the line VI—VI in FIG. 5.
Figure 7:
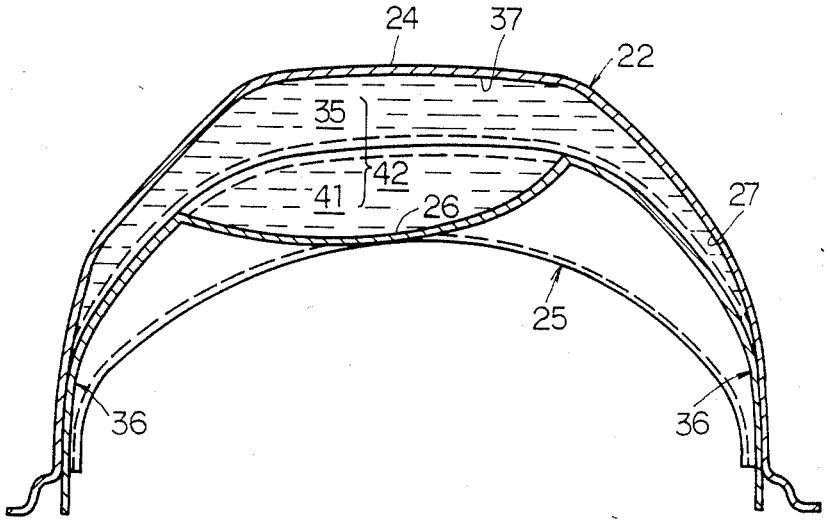
FIG. 7 is an enlarged cross-sectional view taken along the line VII—VII in FIG. 5.
Figure 8:
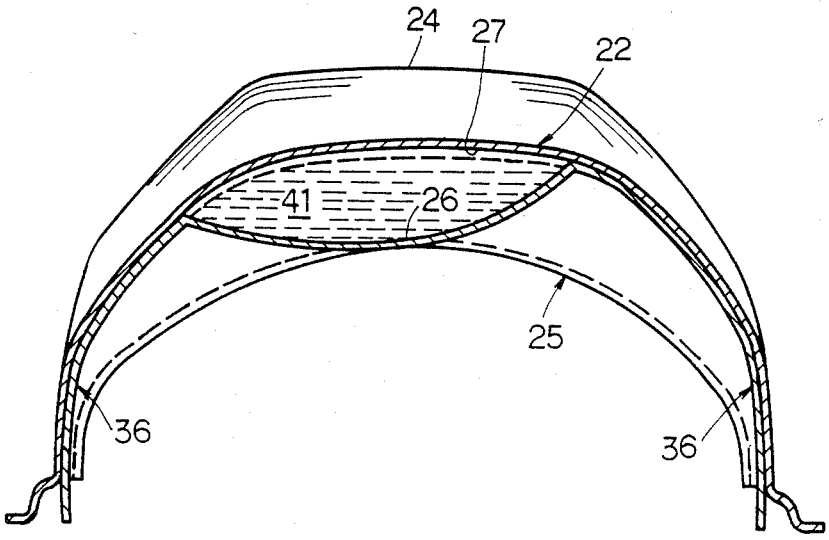
FIG. 8 is an enlarged cross-sectional view taken along the line VIII—VIII in FIG. 5.
Figure 9:
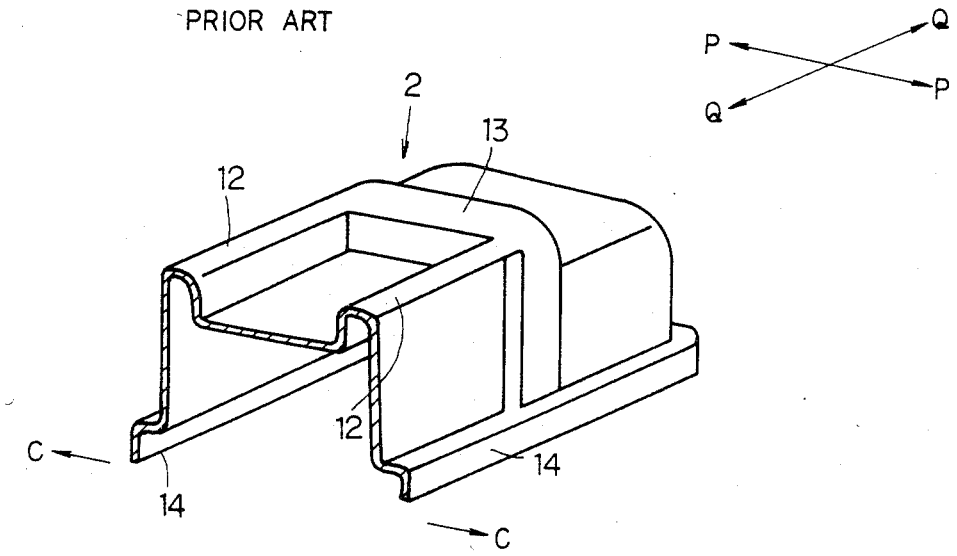
FIG. 9 is a partial perspective view of a cylinder-head cover according to a prior art.
Figure 10:
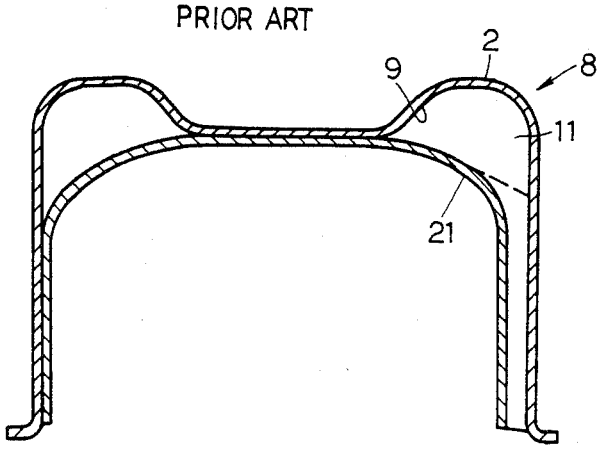
Fig. 10 PRIOR ART
FIG. 10 is a longitudinally cross-sectional view of a gas-oil separator according to a prior art.
Figure 11:
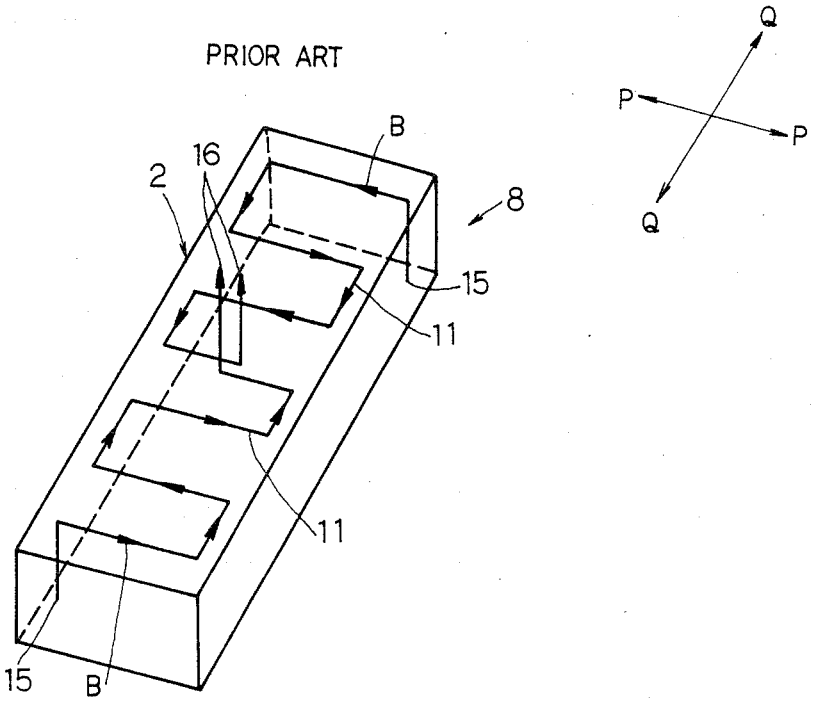
Fig. 11 PRIOR ART
FIG. 11 is a view which illustrates the flow of the blowby gas in a cylinder-head cover.

FIGS. 6, 7 and 8 are the enlarged cross-sectional views taken along the lines VI, VII and VIII in FIG. 5, respectively. As shown in FIGS. 6, 7 and 8, the curved plate 25 is fixed by the welding onto the inner wall 27 of the cylinder-head cover 22. As shown in FIG. 6, there is provided a space 35 between the back side of the extension portions 24 and the curved plate 25. As shown in FIG. 8, there is provided a space 41 defined between the cylinder-head cover 22 and the grooves 26 of the curved plate 25. Further, as shown in FIG. 7, there is provided a space 42 defined between the concavity 37 of the cylinder-head cover 22 and the groove 26 of the curved plate 25, at the intersecting point between the concavity 37 of the cylinder-head cover 22 and the groove 26 of the curved plate 25. The space 42 is a space which comprises the space 35 and the space 41. These spaces 35, 41 and 42 are the passages through which the blowby gas passes. When the engine operates, the blowby gas passes in the direction indicated by the arrow B in FIG. 5. When the blowby gas flows within the passages (the spaces 35, 41 and 42), the oil contained in the blowby gas, drops by its weight and the dropped oil is returned into a reservoir. There is provided an outlet opening **26*a* in the cylinder-head cover 22. After the oil is separated from the blowby gas, the blowby gas is suctioned into the intake passage 5**.

Thus, the groove 26 of the curved plate 25 continues in zigzag form and the depth of the groove 26 is adapted to be large at the central portion 31 of the curved plate 25 and to be small at lateral both end portions 32. Hence, the cross-sectional square of the blowby gas passage varies to a larger or small square, from the entrance of the blowby gas passage unitl the exit of the blowby gas passage. When the blowby gas passes through the blowby gas passage, the small cross-sectional square of the blowby gas passage becomes a restriction resistance, thereby increasing the flow speed of the blowby gas. On the other hand, in the portion where the cross-sectional square of the flow is relatively large such as the place indicated by the spaces 35, 41 and 42, the flow speed of the blowby gas remarkably drops. Hence, the oil mist, which is contained in the blowby gas, is considerably separated from the blowby gas, at the place where the cross-sectional square of the flow is relatively large such as the spaces 34, 41 and 42 in FIGS. 6, 7 and 8. Thus, the oil mist, which is contained in the blowby gas, is separated from the blowby gas.

While the present invention has been described in its preferred embodiments, it is to be understood that the invention is not limited thereto, and may be otherwise embodied within the scope of the following claims.

What is claimed is:

1. A cylinder-head cover for use in an internal combustion engine, through which a blowby gas is suctioned into an intake passage, comprising:

a housing secured to a cylinder head, the housing having a plurality of extension portions which extend in lateral direction thereof, an inlet port for introducing a blowby gas-oil mixture into the housing, and an outlet port for emitting the blowby gas into the intake passage; and a plate means provided within the housing, the plate means forming a cylinder-head passage between its outer surface and an inner surface of the housing, in which the blowby gas-oil mixture passes, the plate means having its outer surface on which a groove is formed such a way as the square of the cross-section of the cylinder-head passage is repeatedly large and small, whereby when a blowby gas-oil mixture passes through a cylinder-head cover, the oil and contaminants contained in the blowby gas-oil mixture drops on the outer surface of the plate means at the place where the square of the cross-section of the cylinder-head passage is large, and thereby the oil and contaminants are separated from the blowby gas-oil mixture.

2. The cylinder-head cover of claim 1, wherein the groove of the plate means extends in zigzags relative to the longitudinal direction of the plate means.

3. The cylinder-head cover of claim 1, wherein widths of the extension portions are not unitary.

4. The cylinder-head cover of claim 1, wherein a blowby gas-oil mixture flows into the cylinder-head passage from opposite longitudinal directions of the cylinder-head cover.

* * * * *